US010604320B1

(12) United States Patent
Robinson

(10) Patent No.: US 10,604,320 B1
(45) Date of Patent: Mar. 31, 2020

(54) PLUMBING SUPPLY TRANSPORT CASE AND METHOD OF SANITIZING AND TRANSPORTING PLUMBING SUPPLIES

(71) Applicant: Jackie Robinson, Detroit, MI (US)

(72) Inventor: Jackie Robinson, Detroit, MI (US)

( * ) Notice: Subject to any disclaimer, the term of this patent is extended or adjusted under 35 U.S.C. 154(b) by 0 days.

(21) Appl. No.: 15/584,421

(22) Filed: May 2, 2017

Related U.S. Application Data

(60) Provisional application No. 62/496,474, filed on Oct. 19, 2016, provisional application No. 62/391,506, filed on May 2, 2016.

(51) Int. Cl.

| | |
|---|---|
| ***B65D 73/00*** | (2006.01) |
| ***B65D 25/28*** | (2006.01) |
| ***B65D 43/16*** | (2006.01) |
| ***B65D 25/22*** | (2006.01) |
| ***B08B 3/04*** | (2006.01) |
| ***E03D 11/00*** | (2006.01) |

(52) U.S. Cl.
CPC ..... *B65D 73/0014* (2013.01); *B08B 3/044* (2013.01); *B65D 25/22* (2013.01); *B65D 25/2802* (2013.01); *B65D 43/164* (2013.01); *E03D 11/00* (2013.01)

(58) Field of Classification Search
None
See application file for complete search history.

(56) References Cited

U.S. PATENT DOCUMENTS

| | | | |
|---|---|---|---|
| 337,888 | A | 3/1886 | Swan |
| 1,927,110 | A | 9/1933 | Bannister et al. |
| 2,569,021 | A | 9/1951 | Rozanski |
| 2,650,449 | A | 9/1953 | Suring |
| 2,825,445 | A | 3/1958 | Golden |
| 2,844,244 | A | 7/1958 | Hanson |
| 3,367,483 | A | 2/1968 | Studen |
| 3,583,556 | A | 6/1971 | Wagner |
| 3,641,697 | A | 2/1972 | Heidtman |

(Continued)

OTHER PUBLICATIONS

Plano Molding Company Rifle Case; see http://www.planomolding.com/hunting/hard-gun-cases/se-series-single-rifle-case.

(Continued)

*Primary Examiner* — Nicole Blan
(74) *Attorney, Agent, or Firm* — University of Detroit Mercy School of Law

(57) ABSTRACT

A device for transporting a plumbing tool that includes an outer housing defining an interior cavity, the outer housing having at least one rigid panel member having an outer periphery with the rigid panel forming a support base. The outer housing also has at least one reclosable drain hole and at least one reclosable access aperture defined therein as well as member mounted on the outer housing that is, movable between a first position in which the at least one reclosable access aperture is open and a second position in which the movable member is in watertight sealed relationship with the outer housing. The device also has at least one first anchor clamp connected to the rigid panel member of the outer housing and projecting into the interior of the interior cavity defined in therein. The at least one first anchor clamp is configured to releasably engage a toilet auger and maintain the toilet auger in fixed relationship relative to the at least one rigid panel.

16 Claims, 11 Drawing Sheets

(56) References Cited

U.S. PATENT DOCUMENTS

| | | | | |
|---|---|---|---|---|
| 3,878,939 | A | 4/1975 | Wilcox | |
| 4,819,800 | A | 4/1989 | Wilson | |
| 5,425,194 | A | 6/1995 | Miller | |
| 5,525,314 | A | 6/1996 | Hurson | |
| 5,676,254 | A | 10/1997 | Cheng | |
| 6,390,294 | B1 | 5/2002 | Fiore, Jr. | |
| 6,450,333 | B1 | 9/2002 | McClenahan | |
| 6,523,687 | B2 | 2/2003 | Ling | |
| 6,755,302 | B1 | 6/2004 | Streich | |
| 8,893,885 | B2 | 11/2014 | Hutchens | |
| 2006/0011624 | A1 | 1/2006 | Shih | |
| 2011/0253180 | A1* | 10/2011 | Davidson | A46B 17/06 134/135 |
| 2012/0012136 | A1* | 1/2012 | Nguyen | A47K 17/00 134/22.12 |

OTHER PUBLICATIONS

Everbilt Spring Grip; see http://www.homedepot.com/p/Everbitt-7-8-in-White-Spring-Grip-18028/202305505.

General Pipe Cleaners, 'Toilet Auger Carrying Case'; see https://www.amazon.com/General-Wire-CABG-Carrying-CaseDrip/dp/B00GHUFMDW.

Craftsman Power Tool Carrying Case; see http://www.kmart.com/my-first-craftsman-power-tools-with-carry-case/p-004W003978319001P.

* cited by examiner

PLUMBING SUPPLY TRANSPORT CASE AND METHOD OF SANITIZING AND TRANSPORTING PLUMBING SUPPLIES

CROSS-REFERENCE TO RELATED APPLICATIONS

This application claims priority to U.S. Provisional Application No. 62/496,474 filed Oct. 19, 2016 and to U.S. Provisional Application No. 62/391,506 filed May 2, 2017. The specifications of both applications are incorporated by references herein in their entireties.

BACKGROUND

This disclosure relates to devices for transporting and storing plumbing devices that are configured to come into contact with human waste such as urine and/or fecal matter. The disclosure also pertains to a method for cleaning and sanitizing one or more plumbing devices that have come into contact with human waste such as urine and/or fecal matter.

Various devices are used in the plumbing repair and maintenance. Among these devices are toilet augers. Such devices are also variously known as plumber's augers, toilet snakes and the like and can be used to loosen clogs that develop in toilets. Generally, such devices can include a coiled metal wire that can be configured with a broader gap between the coils at the terminal end. The coiled metal wire can be operatively connected to a crank mechanism. In hand-operated devices, operator turns the handle of the crank mechanism to rotate the helix as it moves through the pipe. Toilet augers, also called closet augers, can feed a relatively short auger through a hook-shaped length of metal tubing. A hook shape can make it easier to feed the auger into the toilet. A plastic boot on the end of the auger can protect the finish of the visible porcelain. Since most toilet clogs occur in the trap built into the bowl, the short cable is sufficient to break up or retrieve the greater majority of clogs.

Once the device is used, the coiled metal wire can be wet and contaminated with fecal matter and body waste. Removal can and further transport can be a messy business. Thus, it is desirable to provide a device that can house the auger in a suitable manner for transport and future use.

Removal of a contaminated auger also presents complicated cleaning issues. It many situations, the contaminated device must be moved through associated restroom where it can drip on the associated bathroom surfaces and the device may or may be not able to be cleaned. It would be desirable to provide a method for cleaning and/or sanitizing the auger device in a self-contained and effective manner.

SUMMARY

A device for transporting a plumbing tool that includes an outer housing defining an interior cavity, the outer housing having at least one rigid panel member having an outer periphery, the rigid panel forming a support base. The outer housing has at least one reclosable drain hole and at least one reclosable access aperture defined therein. A member is movably mounted on the outer housing. The member is movable between a first position in which the at least one reclosable access aperture is open and a second position in which the movable member is in watertight sealed relationship with the outer housing. The device also has least one first anchor clamp connected to the rigid panel member of the outer housing and projecting into the interior of the interior cavity defined in therein. The at least one first anchor clamp is configured to releasably engage a toilet auger and maintain the toilet auger in fixed relationship relative to the at least one rigid panel.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

DETAILED DESCRIPTION

Figure 1A:
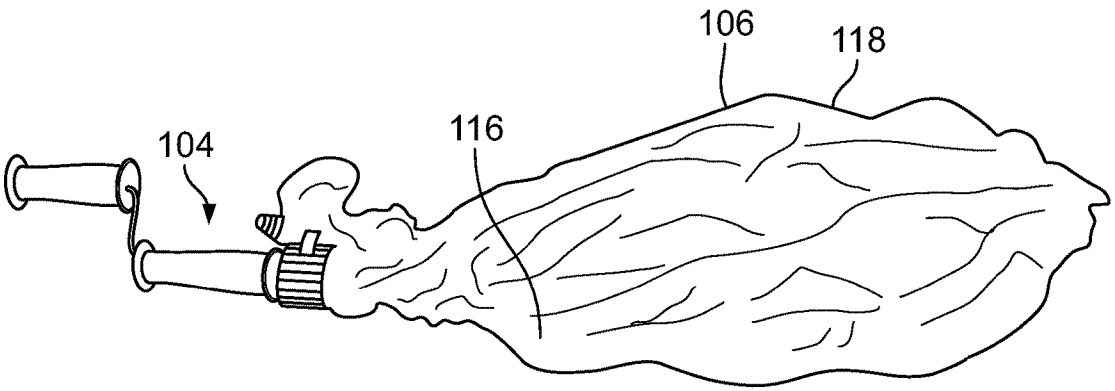
FIG. 1A is a perspective view of a plumbing tool wrapped in a polymeric bag for transportation.
Figure 1B:
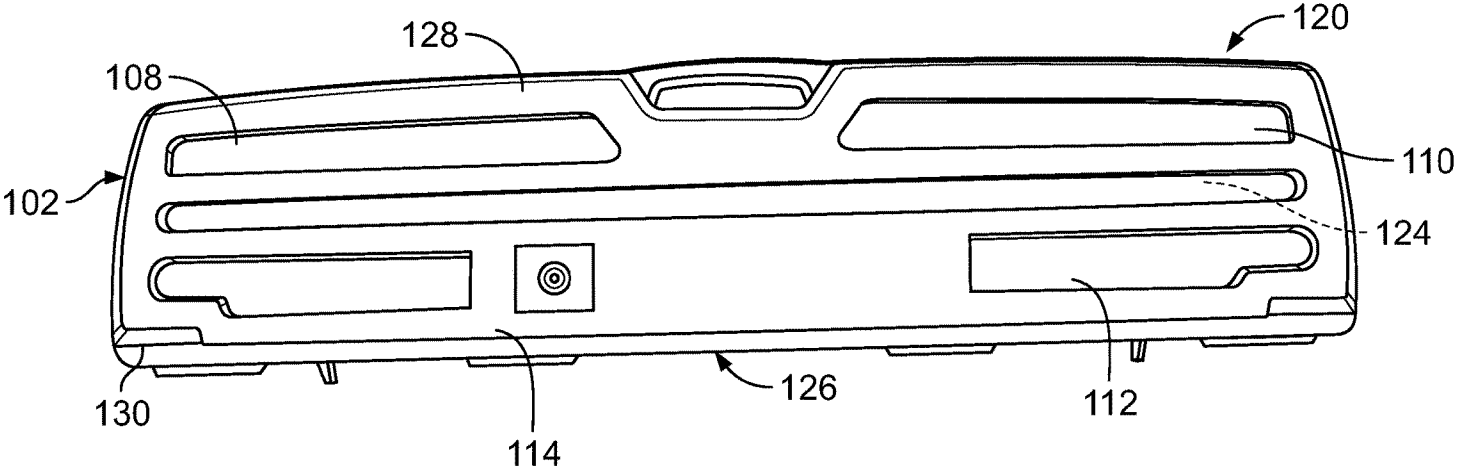
FIG. 1B is a perspective view of first embodiment of the plumbing tool transporting device as disclosed herein in the closed position.

Referring to FIG. 1, a device 102 for transporting a plumbing tool 104 is disclosed. Suitable plumbing tools include devices that become contaminated with biological material and/or fecal solids during use. Such devices pose transport problems as it is undesirable to transport them in a manner that exposes the device to the public and/or provides an opportunity for the device to contaminate various surfaces.

One example of such as plumbing tool 104 is a toilet auger 106. In FIG. 1, the toilet auger 106 is depicted in the manner in which it can be typically transported prior to the development of the plumbing transport device 102, that is the operative contaminated end is wrapped in a plastic garbage bag 118 and removed from the job site such as a the public rest room, office building or the like to the plumber's truck or the like. Where possible, the plumbing tool 104 such as the toilet auger 106 may be first removed to a suitable janitors's closet or work room where the plastic wrap such as garbage bag 118 surrounding plumbing tool 104 can be removed and the plumbing tool 104 can be cleaned and sanitized. Where such facilities do not exist, the plumbing tool 104 can remain wrapped and can be placed dirty in the worker's truck to be cleaned off site. It can be appreciated that materials such as garbage bag 118 are prone to leakage and tearing, thus increasing the risk of dripping and contamination of the work site, the worker's truck or the like. Also, because the job site may not offer the opportunity to clean and sanitize the 104 immediately after the plumbing operation is completed, use of a garbage bag 118 or other plastic wrapping option increases the risk of reuse of the device without sanitizing the plumbing tool 104 between work sites.

The transport device 102 as disclosed herein provides a mechanism for safely transporting one or more tools such as plumbing tool 104 in a manner that minimizes the risks for spillage and site contamination can facilitate an effective method for ready cleaning and sanitizing of one or more tools such as plumbing tool 104 that are employed at a job site.

The device 102 for transporting a plumbing tool 104 such as toilet auger 106 is composed of an outer housing 108 that includes a first panel member 110 with an outer periphery 112. The first panel member 110 is a rigid elongated panel that can be composed of a suitable water impervious material such as a plastic or the like. In certain embodiments, the rigid first panel member 110 forms support base 120. Where desired or required, the support base 120 can be composed of multiple layers of rigid polymeric material.

The outer housing 108 defines an interior cavity 124 that has sufficient volume to receive at least one plumbing tool 104 in fixed, spaced relationship therein. In various embodiments, the outer housing 108 can include at least one reclosable aperture that is configured to receive the at least one plumbing tool 104 into the interior cavity 124 and to permit its removal when desired or required. In the embodiment as depicted, the outer housing 108 also includes at least one outer housing side wall 130 that is connected to to the first panel member 110 and projects angularly therefrom terminating in an edge that is positioned in a plane generally parallel to and disposed from that defined by the first panel member 110. The edge can be configured to include a suitable seal (not shown).

The device 102 also includes a member 126 that is movably mounted relative to the outer housing 108. The movably mounted member 126 is configured and positioned to permit movement between first position in which the reclosable aperture is open permitting access into the interior cavity 124 and a second position in which the movable member 126 is in water tight sealed relationship with the outer housing 108. The device 102 can also include suitable attachment mechanisms to facilitate the attachment of the outer housing 108 to the movable member 126. In the embodiment depicted in FIG. 1, one or more hinge members 114 can be disposed along one side of the device to facilitate pivotal movement between the open and the sealed positions. In order to maintain the outer housing 104 and the movable member in sealed relationship to one another, the device 102 can also include a suitable latch mechanism 128. The latch mechanism 128 can be located at a suitable position on the device 102.

In the embodiment depicted in FIG. 1, the moveable member 126 is configured to be symmetrical to the outer housing 108 with at least one hinge member 114 located along one side to permit the two elements to open and shut in a clamshell-like manner. In the embodiment depicted in FIG. 1, the device 102 also has a handle 116 positioned at a location opposed to the hinge or hinges 114 with the handle 116 and latch mechanism 128 located on the same side.

Figure 2:
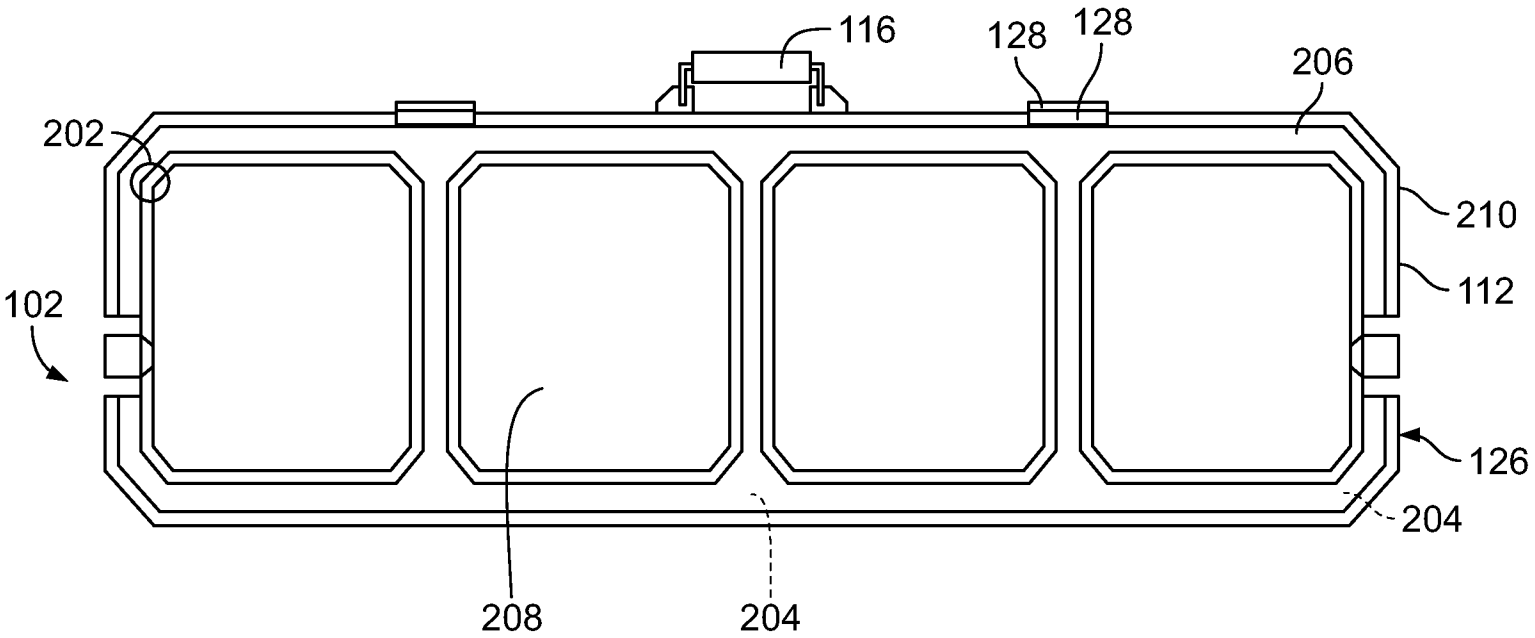
FIG. 2 is a front view of the embodiment of the device depicted in FIG. 1B.

FIG. 2 is directed to a front or top view of the device 102 for transporting a plumbing tool 104 such as a toilet auger 106. This view depicts the moveable member 126 which may be an elongated generally rectangular member that is symmetrical to the outer housing 108. The moveable member 126 can include at least one rigid planar member such a second rigid panel 208 that can include an outer periphery 206. Where desired or required, the moveable member 126 can include suitable reinforcing elements such as reinforcement 204.

In the embodiment illustrated, the moveable member 126 also includes a moveable member side wall 210 is connected to the second rigid panel 208 and projects angularly therefrom and terminates in an edge that is positioned in a plane generally parallel and disposed from that defined by the second rigid panel 208. The edge can be configured to include a suitable seal (not shown).

Where desired or required, the one or both of the outer housing 108 and the moveable member 126 can be configured with a reclosable drain hole such as drain hole 202. The drain hole 202 can be positioned at any suitable location in the device 102. In certain embodiments, the drain hole 202 can be located in the rigid first panel member 110, 208 region of the associated element at a location that will facilitate the addition and/or removal of cleaning fluid to and from the device 102.

Figure 8:
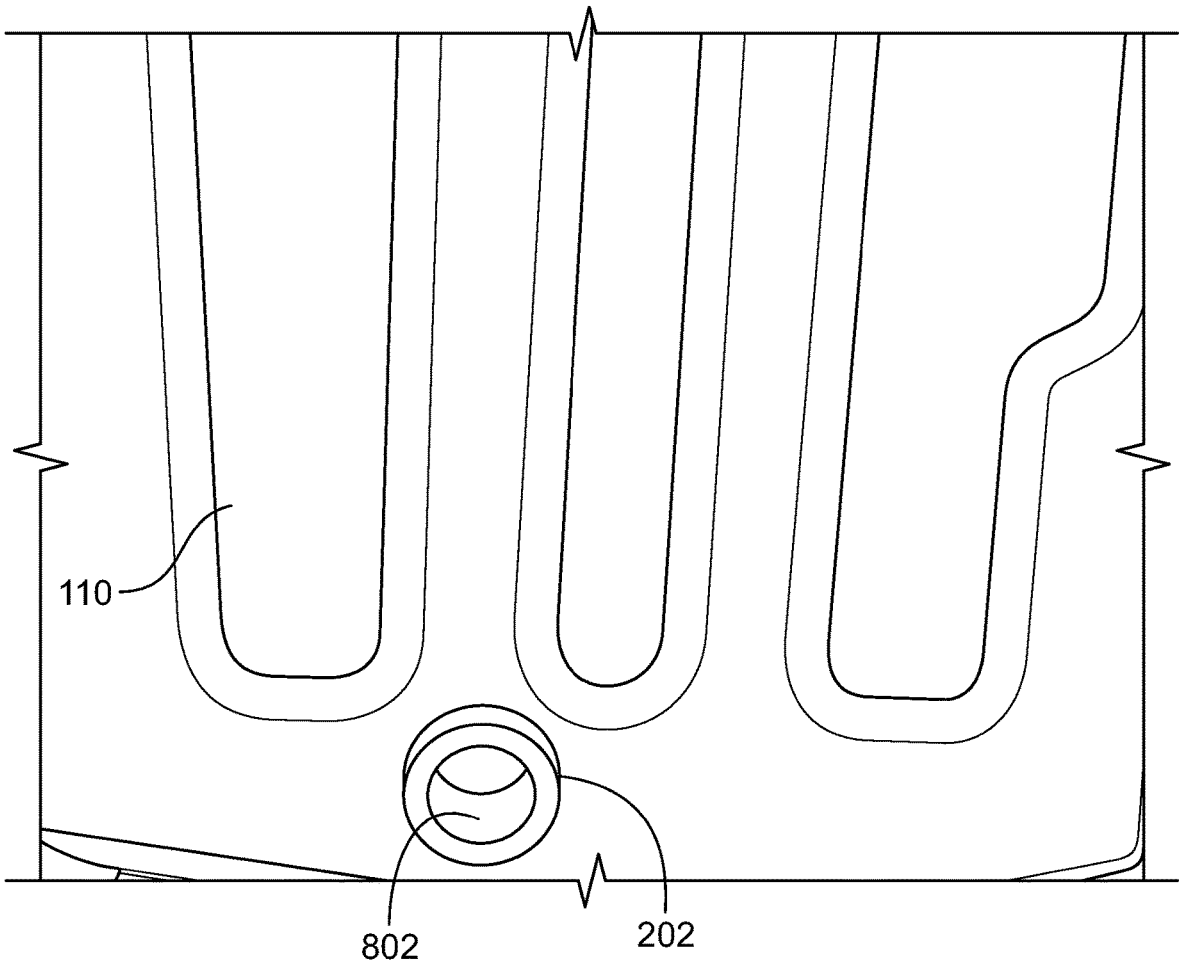
FIG. 8 is a detail of an embodiment of the drain hole 202 as disclosed herein.

The drain hole 202 extends through the associated element to provide access to the interior cavity 124 defined therein. The drain hole 202 can be configured with suitable elements to facilitate engagement with water conduits or the like such as internal threads 702 as depicted in FIG. 8. It is also contemplated that the drain hole 202 can be configured to include a suitable cap (not show) that sealing closes the drain hole 202. Engagement between the drain hole 202 and the cap can be accomplished by any suitable mechanism such as threading, snap fitting and the like.

Figure 3:
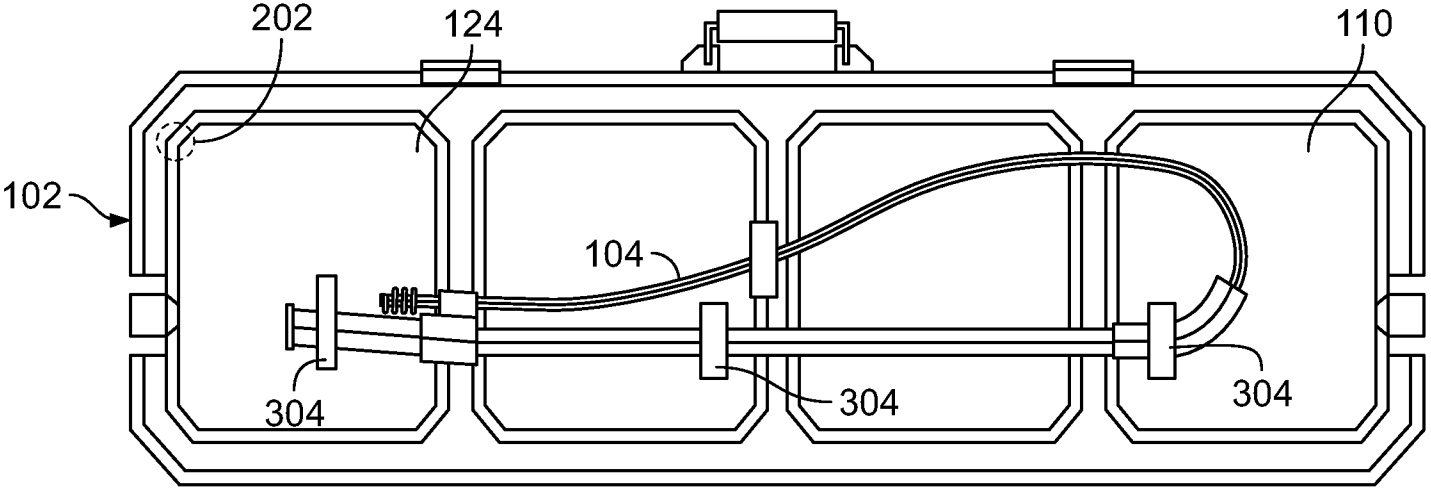
FIG. 3 is a cross sectional view of the embodiment of the device of FIG. 1B.
Figure 4A:
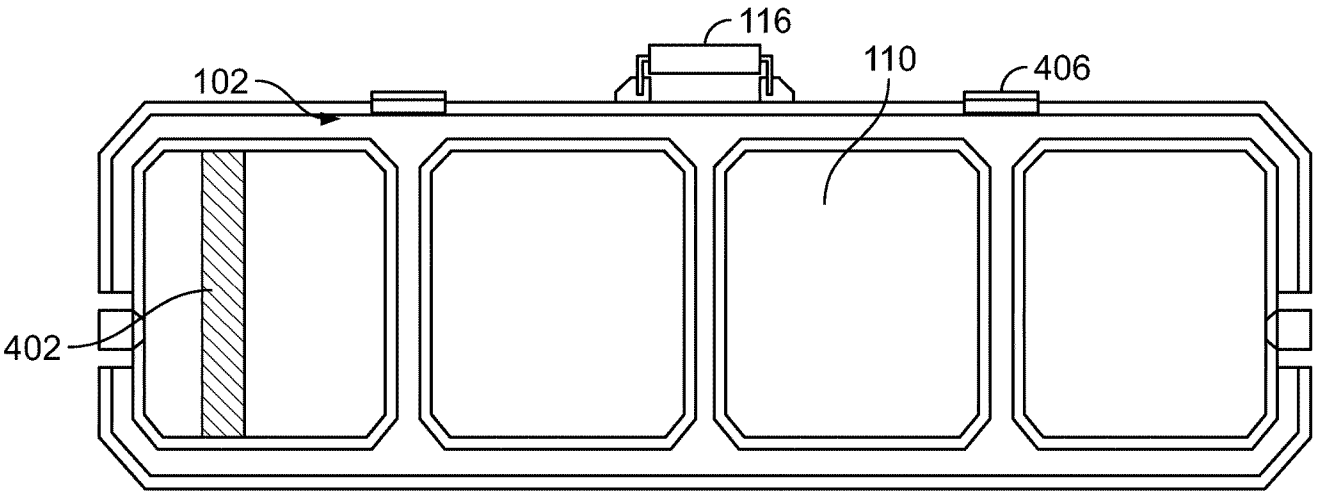
FIG. 4 is a rear view of the embodiment of the device of FIG. 1B.
Figure 4B:
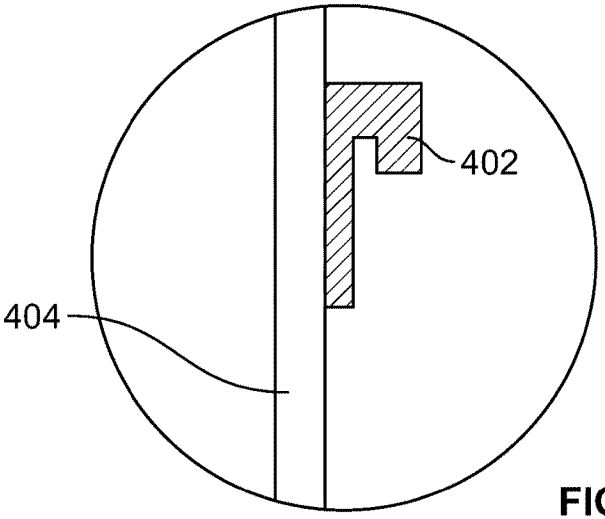
Figure 5:
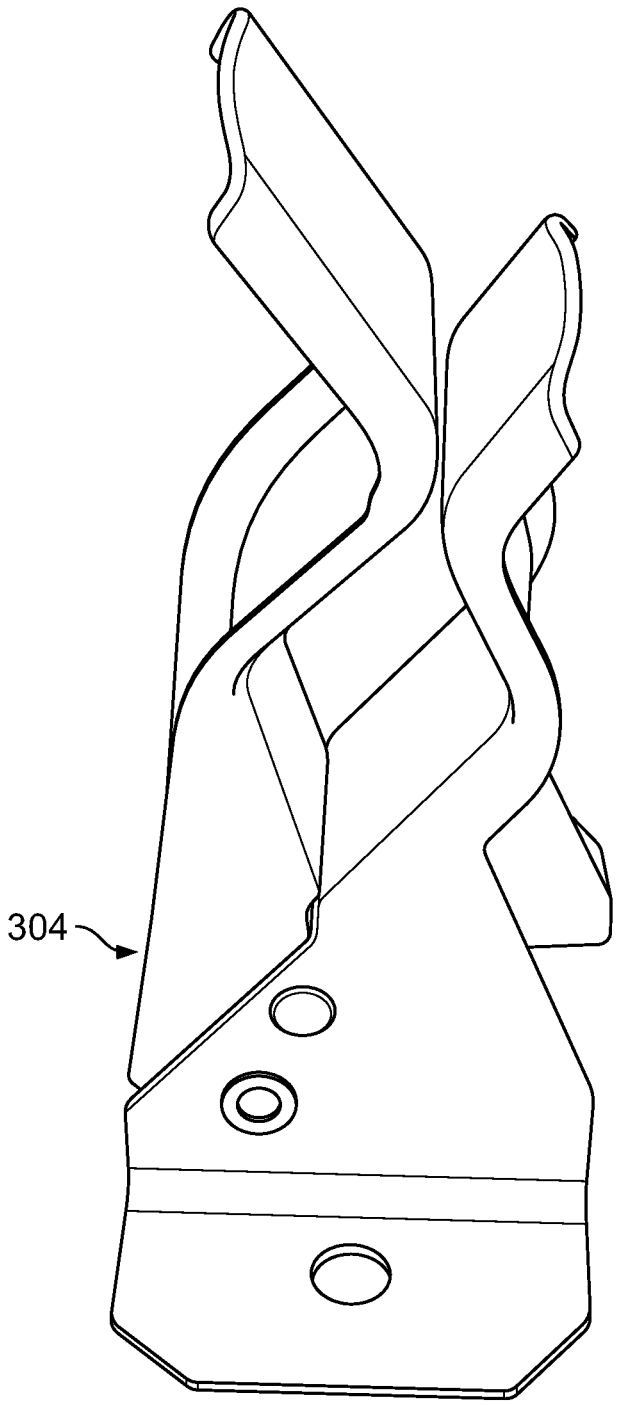
FIG. 5 illustrates an aspect of the subject matter in accordance with one embodiment.
Figure 6:
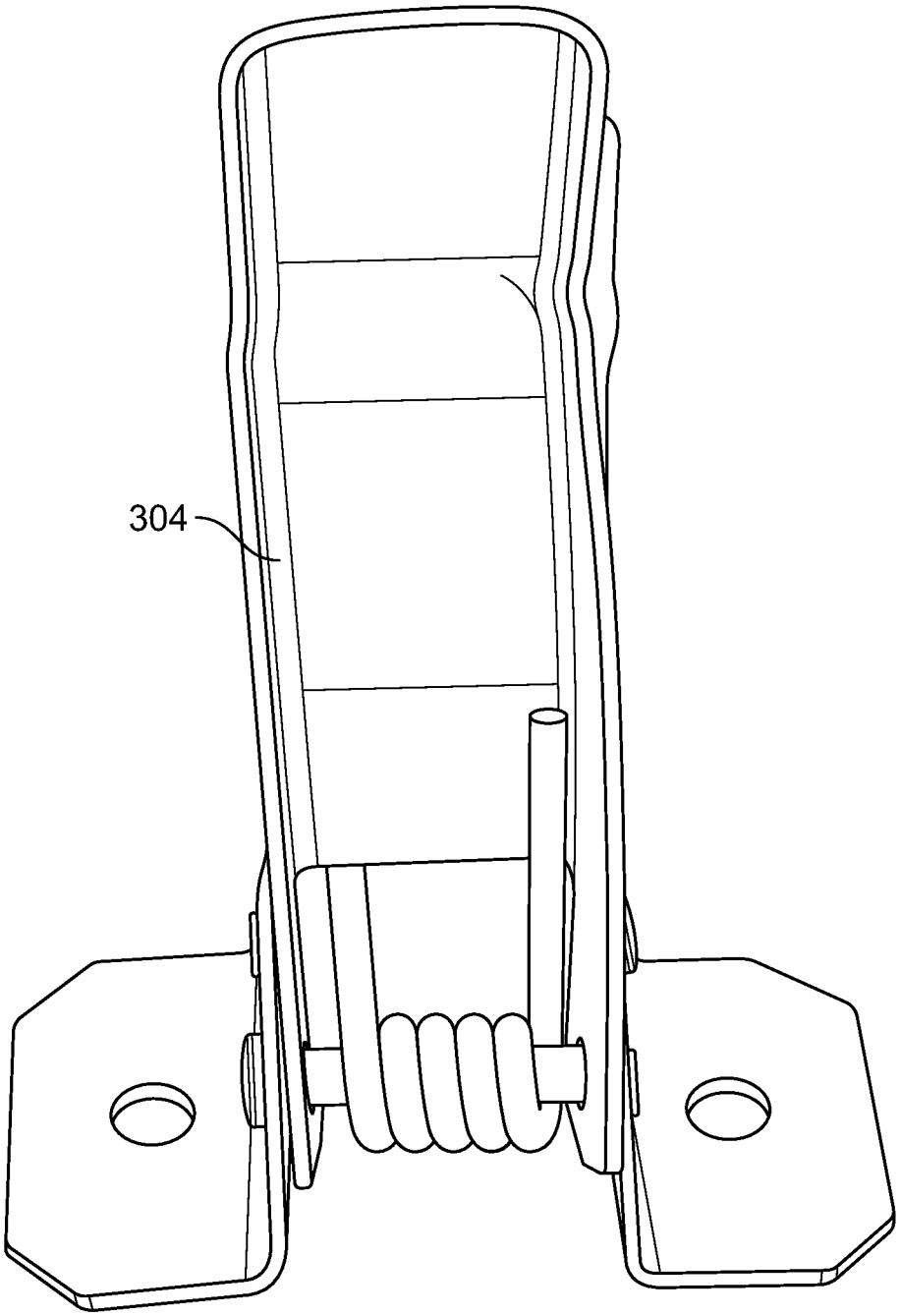
FIG. 6 illustrates an aspect of the subject matter in accordance with one embodiment.

FIG. 3 illustrates a non-limiting example of a plumbing tool 104 such as toilet auger 106 in position in the interior cavity 124 defined in device 102. The interior cavity 124 of outer housing 108 can include at least one first anchor clamp 304 affixed to the interior facing surface of the outer housing rigid member 110 to removably receive the plumbing tool 104 in fixed relationship thereto. In certain embodiments, the at least one first anchor clamp 304 can project into the interior cavity to position the plumbing tool 104 at a spaced distance from the interior surfaces of the moveable member 126 and the outer housing 108. Where desired or required, the at least one first anchor clamp 304 can be a suitable spring-loaded clamp, a non-limiting example of such is illustrated in FIG. 5 and FIG. 6.

The number of first anchor clamp(s) 304 that are located in the interior cavity 124 will be that necessary to hold the plumbing tool 104 in position relative to the interior cavity 124. In certain embodiments this number will be between two and seven as when a toilet auger 106 is to be contained in the interior cavity 124.

Each first anchor clamp 304 will be positioned such that the plumbing tool 104 is located a spaced distance from the drain hole 202 when the plumbing tool 104 in fixed position in the interior cavity 124. Without being bound to any theory, it is believed that that the spaced distance between the drain hole 202 and plumbing tool 104 facilitates agitation and turbulence when cleaning liquid is introduced through the drain hole 202 to provide enhanced cleaning action during the initial introduction cleaning liquid phases.

This induced turbulence is particularly evident when the cleaning fluid is introduced into the device in the sealed condition.

Once the desired amount of cleaning liquid is introduced in to the device 102, the drain hole 202 can be closed and the device 102 transported. In many applications, the volume of cleaning liquid introduced will be less than the volume of the interior cavity. The action of transporting the device 102 from the work site can create further agitation that can serve to loosen any material adhering to the plumbing tool 104. Once the device 102 is transported to a suitable site, the drain hole 202 can be opened and the cleaning liquid can be disposed of in an environmentally suitable manner.

The cleaning liquid employed can be an aqueous material that can include suitable amounts of one or more surfactants, sequestrants antibacterials, antimicrobials and the like as desired or required.

While introduction of the cleaning fluid has been discussed with regard to the drain hole 202, it is within the purview of this disclosure to introduce cleaning fluid into the interior chamber prior to closing the device if desired.

Where desired, the device 102 can be configured with a hanger or other suitable mounting member to permit the device to be mounted to a wall or other upright member for storage and the like. One non-limiting example of such a mounting device is a lateral bracket 402 attached to the outer surface 402.

A suitable embodiment of a first anchor clamp 304 is illustrated in FIG. 6 and FIG. 5.

Figure 7:
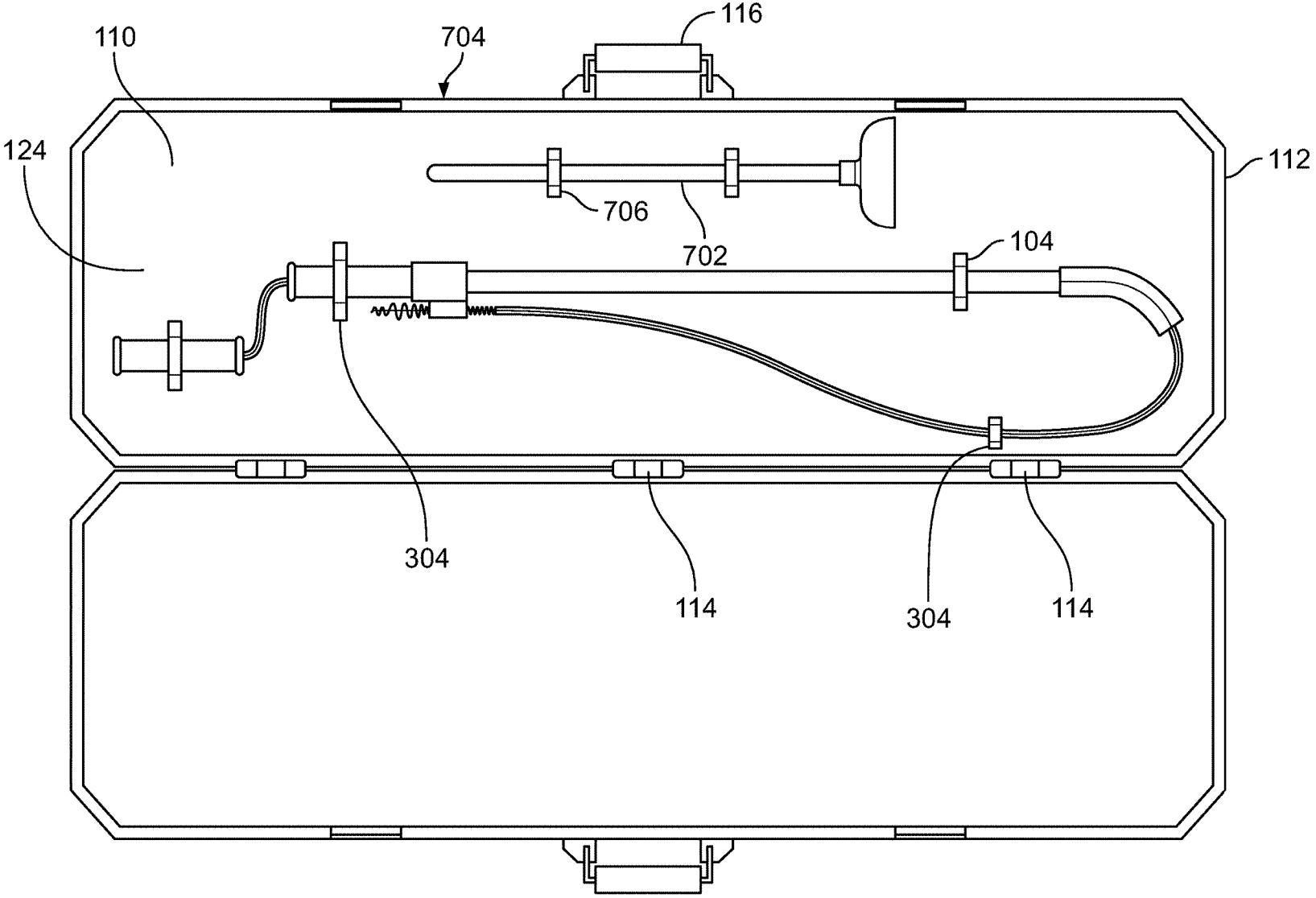
FIG. 7 is a plan view of a second embodiment of the device for transporting at least one plumbing tool as disclosed herein.

An alternate embodiment for transporting multiple plumbing tools of similar or different configurations is illustrated in FIG. 7. In certain embodiments, the device can be configured to accommodate more than one plumbing tool 104. it is contemplated that the device 704 can be configured to accommodate two plumbing devices that would require cleaning and sanitizing such as a toilet auger 106 and a plunger 702. In such embodiments, the device 102 will include at least on second anchor clamp member 706 configured to secure the plunger 702 in a manner that facilitates cleaning. The device 704 will include at least one drain hole 202 at a suitable location and can be employed in the manner describe previously.

Figure 9:
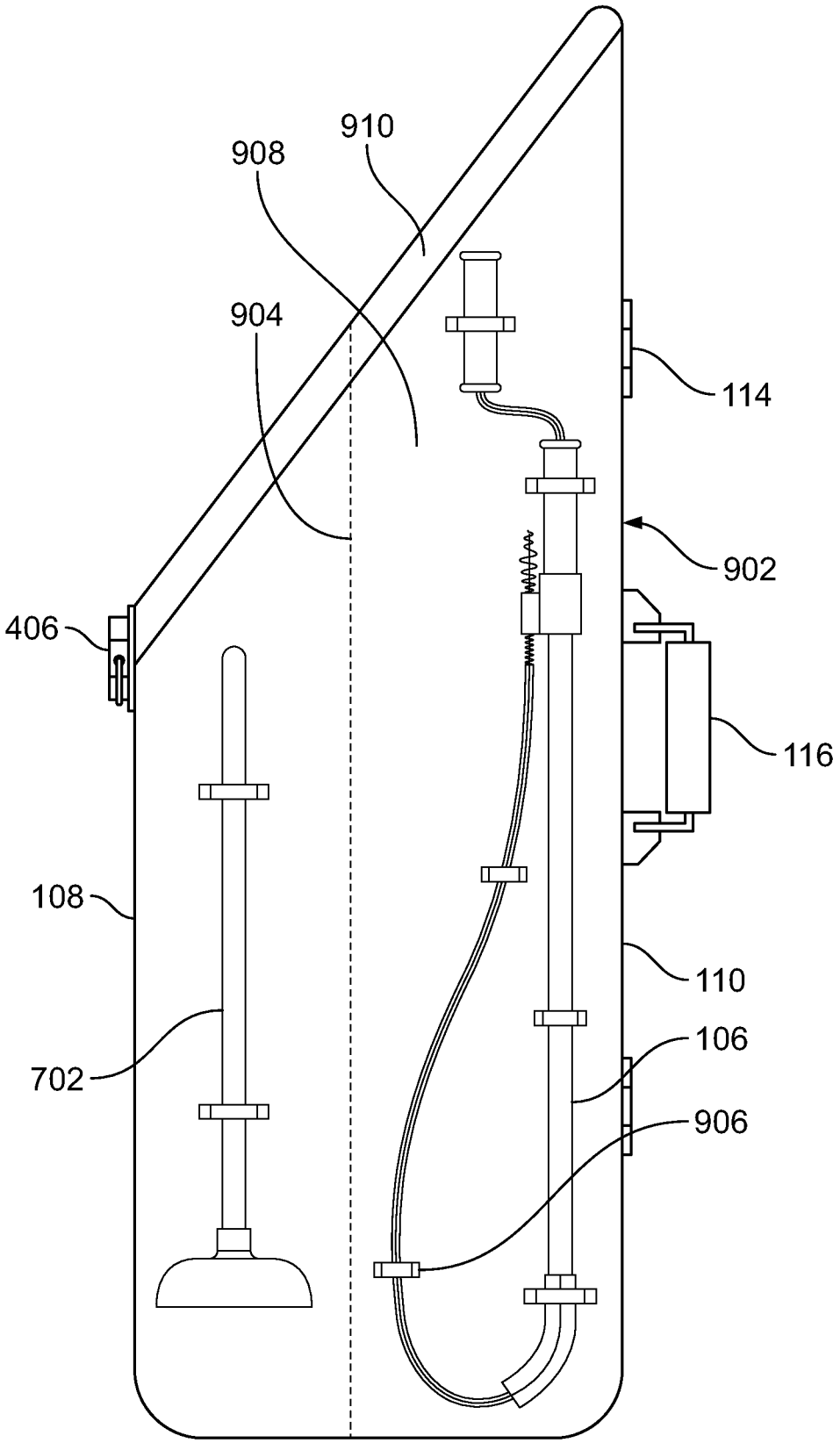
FIG. 9 is an alternate embodiment of the device as disclosed herein.
Figure 10:
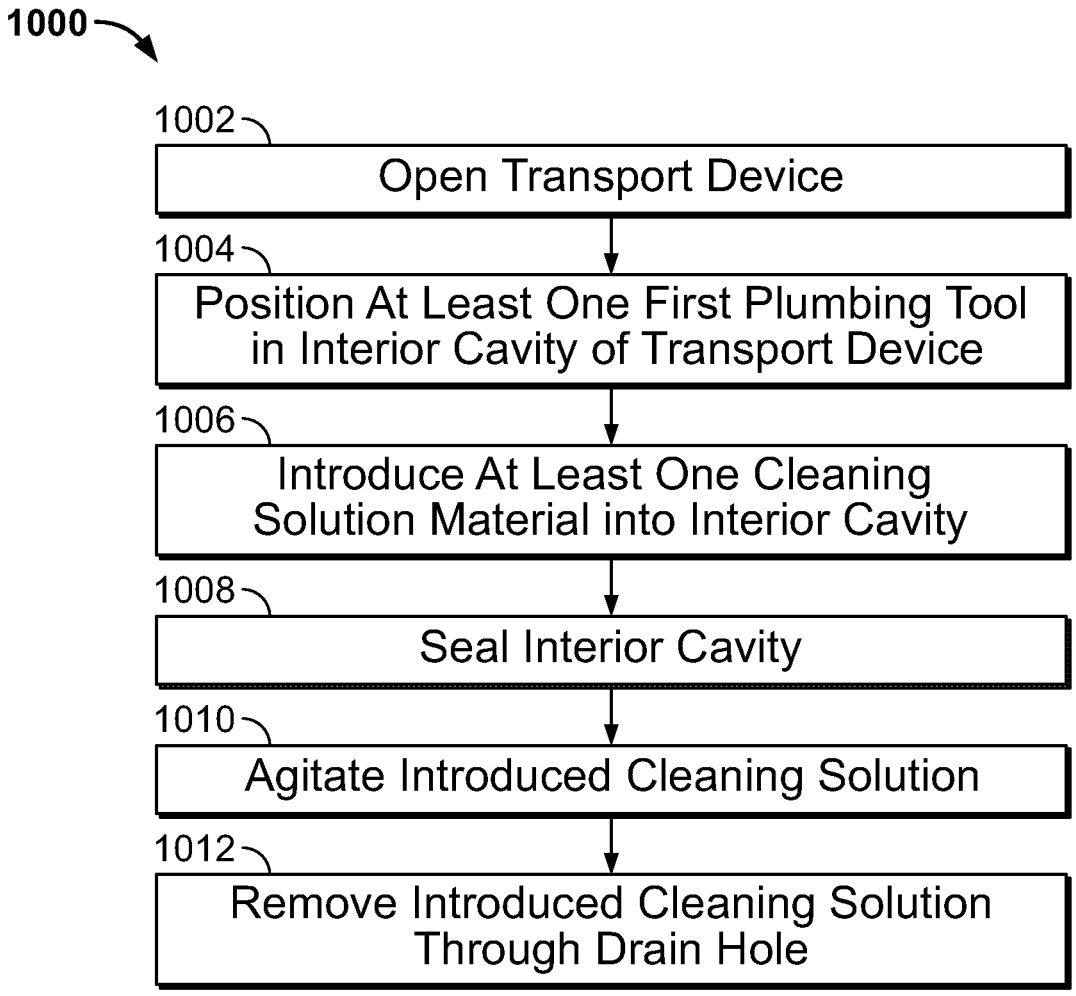
FIG. 10 is a process diagram of an embodiment of the cleaning method as disclosed herein.
Figure 11A:
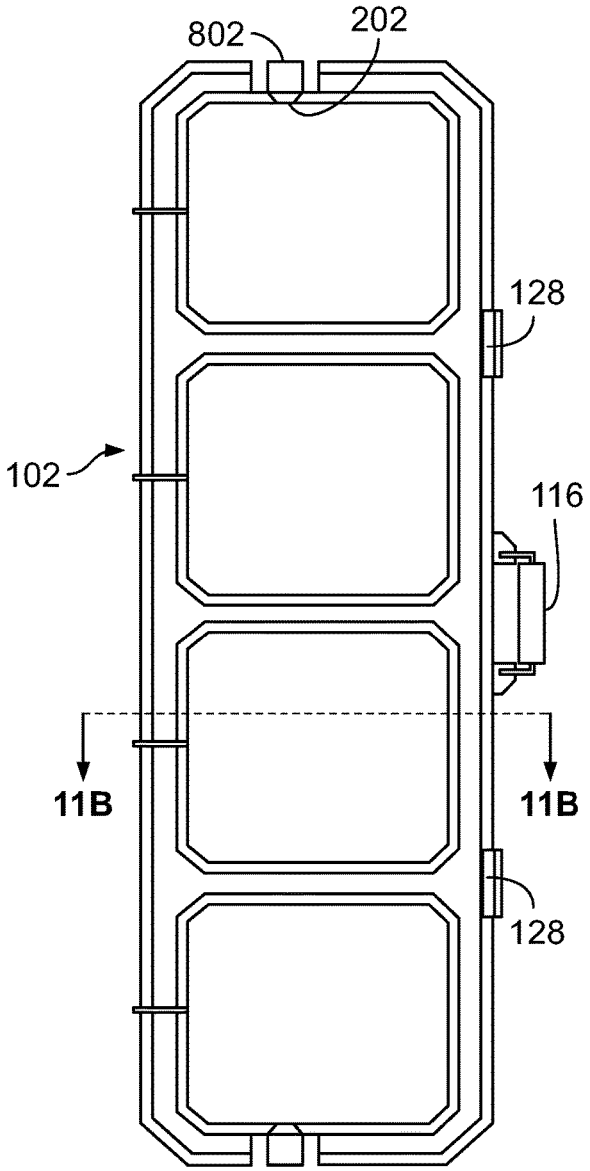
FIG. 11A is a top plan view of the embodiment of FIG. 1A.
Figure 11B:
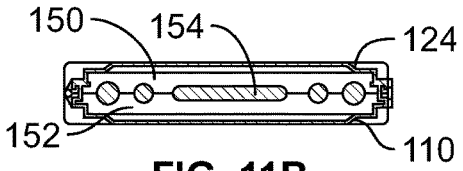
FIG. 11B is a cross-sectional view of FIG. 11A taken along the 11B-11B line.
Figure 11C:
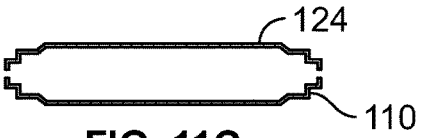
FIG. 11C is a detail cross-sectional view of an embodiment of the outer housing of the device of FIG. 1B.

FIG. 9 is directed to an alternate configuration of the device 902 for transporting at least one plumbing tool. In the embodiment as depicted, the plumbing tools included are a toilet auger 106 and a plunger 702. Where desired or required, the device 902 can be employed to transport multiple toilet augers or the like.

The device 902 an outer housing 108, a first panel member 110, a hinge member 114, a handle 116, a latch 406, a plunger 702, a moveable member 910, a device 902, a divider wall 904, a support base 906, and a reclosable access aperture 908.

As outlined in the process diagram 1000, the method for cleaning at least one plumbing tool such as plumbing tool 104 includes the step of opening a transport device such as device 102, device 702 or device 902 as depicted at block 1002. at least one first plumbing tool such as plumbing tool 104 is positioned in the interior cavity such as interior cavity 124 as at a block 1004. This can be accomplished by engaging the plumbing tool 104 with at least one first anchor clamp. A cleaning solution is introduced into the interior cavity as at block 1006. the interior cavity can be sealed as at block 1008. Cleaning solution can occur prior to or after the interior cavity is sealed.

Once the cleaning solution is introduced into the sealed cavity, the solution can remain in the cavity for an interval of at least 1 minute; with an interval between 1 and 10 minutes being employed in certain situations. The interval can occur with agitation as at block 1010. Once the interval has expired and/or the device 102 has been transported to a suitable location, the cleaning solution can be removed through the drain hole as at block 1012.

While the invention has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A device for transporting a plumbing tool, comprising:

an outer housing defining an interior cavity, the outer housing having at least one rigid panel member having an outer periphery, the at least one ridged panel member forming a support base, the outer housing having at least one reclosable drain hole and at least one reclosable access aperture defined therein;

a member movably mounted on the outer housing, the member movable between a first position in which the at least one reclosable access aperture is open and a second position in which the movable member is in watertight sealed relationship with the outer housing;

a toilet auger; and at least one first anchor clamp connected to the at least one ridged panel member member of the outer housing and projecting into the interior of the interior cavity defined in therein, the at least one first anchor clamp configured to releasably engage the toilet auger and maintain the toilet auger in fixed relationship relative to the at least one ridged panel member.

2. The device of claim 1 wherein the member movably mounted on the outer housing includes at least one second rigid panel.

3. The device of claim 1 further comprising at least one seal member, the seal member interposed between an outer edge of the housing and associated outer edge of the moveable member.

4. The device of claim 1 further comprising at least one sealing plug removably connected to the at least one drain hole defined in the outer housing.

5. The device of claim 1 wherein the outer housing is elongated and has at least one outer housing side wall projected from the outer periphery of the at least one rigid panel member at an angle thereto, wherein a seal member is interposed between the at least one outer housing side wall and the member when the member sealingly engages the outer housing.

6. The device of claim 5 wherein the member movably mounted on the outer housing includes at least one movable member rigid panel, the at least one movable member rigid panel having a perimeter, wherein the at least one movable member rigid panel is in spaced overlying relationship with the at least one rigid panel member of the outer housing.

7. The device of claim 6 wherein the movable member is in spaced overlying relationship with the support base of the outer housing when the movable member is in the second position.

8. The device of claim 7 wherein the movable member is configured symmetrically to the outer housing, the device further comprising at least one hinge member connected to the outer housing and to the movable member.

9. The device of claim 8 further comprising a plunger; and at least one second anchor clamp member, the second anchor clamp member connected to the at least one rigid panel member of the outer housing and projecting into the interior of the interior cavity defined in therein, the at least one second anchor clamp member configured to releasably engage the plunger and maintain it in fixed relationship relative to the at least one rigid panel member of the outer housing.

10. A method for cleaning a plumbing tool comprising the steps of:

positioning at least one plumbing tool in a device, the device comprising:

an outer housing defining an interior cavity, the outer housing having at least one rigid panel member having an outer periphery, the at least one rigid panel member forming a support base, the outer housing having at least one reclosable drain hole and at least one reclosable access aperture defined therein;

a member movably mounted on the outer housing, the member movable between a first position in which the at least one reclosable access aperture is open and a second position in which the movable member is in watertight sealed relationship with the outer housing;

at least one first anchor clamp connected to the at least one rigid panel member of the outer housing and projecting into the interior of the interior cavity defined in therein, the at least one first anchor clamp configured to releasably engage at least one plumbing tool and maintain the at least one plumbing tool in fixed relationship relative to the at least one rigid panel member, wherein the at least one plumbing tool is a toilet auger;

moving the member movably mounted on the outer housing of the device to the first position in which the at least one reclosable access aperture is open;

positioning the toilet auger in the interior cavity defined in the outer housing in releasable contact with the at least one first anchor clamp;

once the toilet auger is in position in the interior cavity, moving the member movably mounted to the outer housing to the second position wherein the member is in watertight sealed relationship with the outer housing and the toilet auger is in the interior cavity;

introducing at least one cleaning solution material into the interior cavity and into contact with the toilet auger through the at least one reclosable drain hole once the toilet auger is in fixed relationship to the at least one first anchor clamp;

closing the at least one reclosable drain hole and agitating the introduced cleaning solution present in the interior cavity for an agitation interval; and after the agitation interval, removing the introduced cleaning solution from contact with the toilet auger through the at least one reclosable drain hole.

11. The method of claim 10 wherein the device of claim 1 further comprises at least one second anchor clamp and wherein the method further comprises the step of positioning a second plumbing tool in fixed relationship with the at least one second anchor clamp, wherein the second plumbing tool is positioned in the interior cavity in spaced relationship relative to the toilet auger.

12. The method of claim 11 wherein the second plumbing tool is a toilet auger or a plunger.

13. The method of claim 11 wherein the device further comprises at least one sealing plug removably connected to the least one reclosable drain hole defined in the outer housing.

14. The method of claim 10 wherein the outer housing is elongated and has at least one outer housing side wall projecting from the outer periphery of the at least one rigid panel member of the outer housing at an angle thereto and wherein the device further comprises a seal member interposed between the at least one outer housing side wall and the member when the member sealingly engages the outer housing.

15. The method of claim 14 wherein the wherein the member movably mounted on the outer housing includes at least one moveable member rigid panel, the at least one moveable member rigid panel having a perimeter, wherein the at least one moveable member rigid panel is in spaced overlying relationship with the at least one rigid panel member of the outer housing.

16. The method of claim 15 wherein the member moveably mounted on the outer housing is configured symmetrically to the outer housing and the device further comprises at least one hinge member connected to the outer housing and to the member movably mounted to the outer housing.

* * * * *